United States Patent [19]

Kessler et al.

[11] 4,299,342

[45] Nov. 10, 1981

[54] COAT HANGER CARRIER

[76] Inventors: Milton Kessler, 6690 Harrington Ave., Youngstown, Ohio 44512; Ronald N. Kessler, 1161 Monsell Dr., Youngstown, Ohio 44505

[21] Appl. No.: 76,191

[22] Filed: Sep. 17, 1979

[51] Int. Cl.[3] ..... A45C 71/00

[52] U.S. Cl. ..... 294/149; 248/340; 294/137

[58] Field of Search ..... 224/45 P, 45 Q, 45 T, 224/45 W, 268; 248/215, 304, 339, 340

[56] References Cited

U.S. PATENT DOCUMENTS

| | | | |
|---|---|---|---|
| 3,584,772 | 6/1971 | Robertson | 224/45 T |
| 3,675,834 | 7/1972 | Peters | 224/45 T |
| 3,705,674 | 12/1972 | Fisher | 224/45 T |
| 3,744,600 | 7/1973 | Belland et al. | 224/45 T X |
| 3,799,416 | 3/1974 | Schmaltz | 224/45 T |
| 4,023,762 | 5/1977 | Batts et al. | 248/340 X |

*Primary Examiner*—Steven M. Pollard
*Attorney, Agent, or Firm*—Burge & Porter Co., L.P.A.

[57] ABSTRACT

A carrier for releasably receiving, retaining and carrying hook portions of a plurality of coat hangers includes a C-shaped member having upper and lower portions which overlie each other and which extend substantially in a common plane. The upper leg portion is of sufficient size relative to the size of one's hand to effectively distribute the load of a plurality of garment-carrying hangers across the width of one's hand. The lower leg portion is provided with a hanger-hook receiving structure which defines an opening extending parallel to at least a part of the lower leg portion for releasably receiving and retaining hook portions of a plurality of hangers with such hangers extending substantially within the common plane. In one embodiment, the receiving structure includes a depending formation defining the opening into which a plurality of hanger-hooks are insertable. In another embodiment, the receiving structure includes a flexible strap which may be wrapped around a plurality of hanger-hooks to define the receiving opening.

11 Claims, 14 Drawing Figures

COAT HANGER CARRIER

REFERENCE TO RELATED DISCLOSURE DOCUMENT

Reference is made herewith to Disclosure Document No. 082,128 filed in the U.S. Patent and Trademark Office on July 2, 1979, disclosing the essence of the present invention.

BACKGROUND OF THE INVENTION

1. Field of the Invention

The present invention relates generally to a coat hanger carrier of the type intended for use with garment bags wherein an array of hook portions of loaded coat hangers project from the upper end of the garment bag and must be held together and supported in order to carry the garment bag.

2. Prior Art

It is customary to cover certain hangable garments such as suits, dresses, and coats with a garment bag for travel. The garments are hung on conventional coat hangers and the hangers are aligned with their hook portions arranged in a side-by-side array. A garment bag is then inserted over the collection of garments and the hanger-hook array is caused to extend through an opening in the top of the bag. Since the hook portions are normally formed of relatively thin wire, it is uncomfortable to hold an array of these heavily loaded hanger-hooks in one's hand while transporting the bag for any significant distance.

In an effort to enlarge the hanger surface area engaged by one's hand in carrying a plurality of hangers, some persons have wrapped tape around the array of hanger hooks. This proposed solution necessitates that tape be removed when access is to be had to garments carried on the hangers, and requires that new tape be applied when one is again ready to travel.

SUMMARY OF THE INVENTION

The present invention overcomes the foregoing and other drawbacks of the prior art by providing a novel and improved carrier for releasably retaining an array of hanger hook portions and for distributing the weight of heavily loaded hangers across the width of one's hand.

A carrier embodying the preferred practice of the present invention includes a substantially C-shaped member having upper and lower leg portions which overlap each other and which extend substantially in a common plane. The upper leg portion is of sufficient size and cross section relative to the size of one's hand to effectively distribute the weight of heavily loaded hangers across the width of one's hand. The lower leg portion has a hanger-hook receiving structure defining an opening which extends parallel to at least a part of the lower leg portion for releasably receiving and retaining hanger-hook portions with their associated hangers extending substantially within the common plane. The receiving structure is located at a position approximately below the center of gravity of upper leg portion so that the upper leg portion will tend to uniformly load such portions of one's hand as engage it. Carriers of this type enable one to comfortably transport heavily loaded garment bags without excessively stressing one or two fingers as commonly occurs when one trys to directly carry several relatively heavily loaded coat hangers.

A principal feature of the present invention lies in the provision of a coat hanger carrier which can be releasably secured to hanger hook portions and which, when utilized to carry a plurality of relatively heavily loaded hangers, will present no sharp edges or corners to cause discomfort to the person using the unit.

A further feature of the present invention lies in the provision of a coat hanger carrier which can be fabricated sufficiently economically and inexpensively that it can be sold for a relatively low price or given away as a sales promotion item. In one embodiment, the carrier is molded as a single piece and is preferably formed from relatively inexpensive plastics material. In another embodiment, the carrier is formed from a molded C-shaped member having a flexible strap secured to the lower leg portion for wrapping around a plurality of aligned hanger-hook portions to receive and releasably retain the hanger-hook portions.

A further feature of the invention lies in the provision of a coat hanger carrier which will remain releasably attached to a plurality of coat hangers even when one's hand is no longer in contact with the carrier. Still another feature lies in the provision of a coat hanger carrier which can be hung on a hook or a coat rod for storing either the carrier itself or for storing a loaded garment bag.

These and other features, and a fuller understanding of the invention will be had by referring to the following description and claims taken in conjunction with the accompanying drawings.

DESCRIPTION OF THE PREFERRED EMBODIMENT

Figure 1:
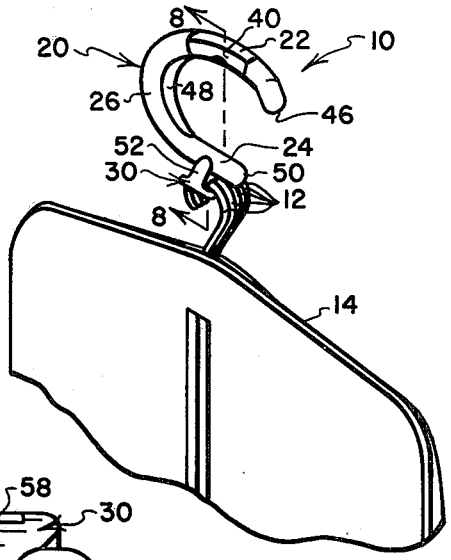
FIG. 1 is a perspective view showing a preferred embodiment of coat hanger carrier in receiving relationship with hanger-hook portions projecting upwardly from a garment bag.
Figure 5:
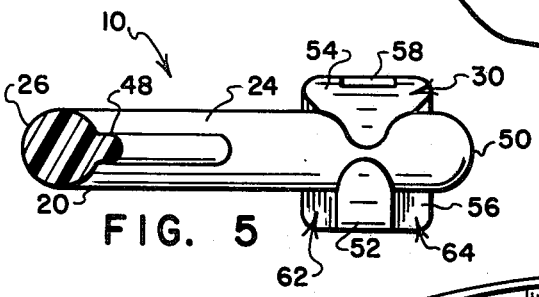
FIG. 5 is a sectional view, as seen from a plane indicated by a line 5—5 in FIG. 2.
Figure 4:
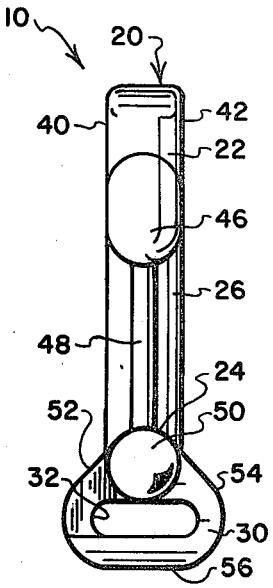
FIG. 4 is an end elevational view of the carrier of FIG. 2.

Referring to FIGS. 1–8, a coat hanger carrier of the type embodying the preferred practice of the present invention is indicated generally by the numeral 10. In FIG. 1, the carrier 10 is shown in receiving relationship with a plurality of hanger-hook portions 12 which project upwardly from an opening in the top of a garment bag 14. As will be understood, the garment bag 14 protectively shrouds a plurality of garments (not shown) carried on the bottom portions (not shown) of hangers whose hook portions 12 project upwardly from the garment bag 14.

Referring to FIGS. 2–8, the carrier 10 includes a substantially C-shaped member 20 having upper, lower and central portions 22, 24, 26 which overlie each other and which extend substantially in a common plane. The upper leg portion 22 is of sufficient size relative to the size of one's hand to effectively distribute the load of a plurality of heavily ladened garment-carrying hangers across the width of one's hand. The lower leg portion 24 is provided with a hanger-hook receiving structure 30 defining an opening 32 which extends parallel to at least a part of the bottom leg portion 24 to releasably receive and retain hanger hook portions 12 of a plurality of coat hangers with the hangers being oriented to extend substantially within the common plane of the C-shaped member.

Figure 2:
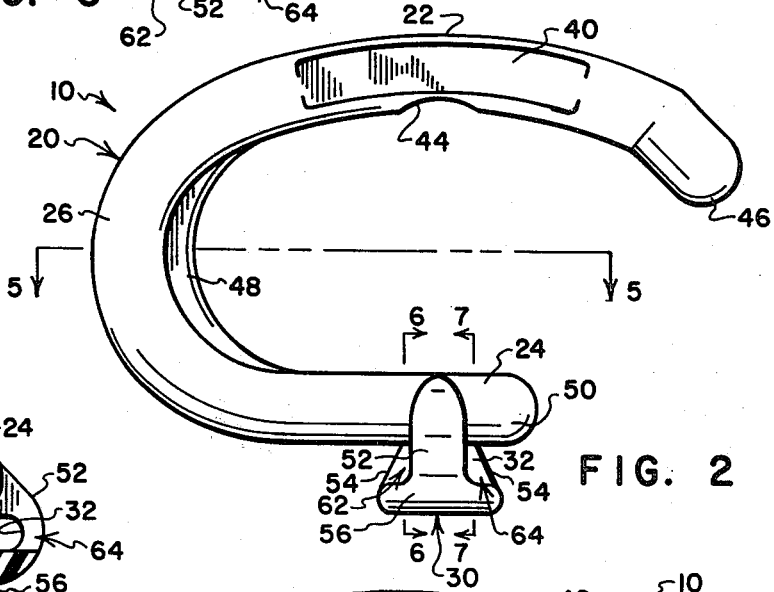
FIG. 2 is a front side elevational view, on an enlarged scale, of the carrier of FIG. 1.
Figure 8:
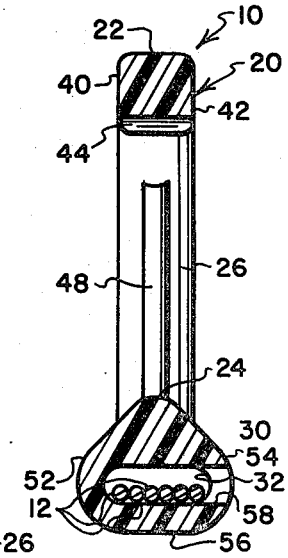
FIG. 8 is a sectional view as seen from a plane indicated by a line 8—8 in FIG. 1.
Figure 3:
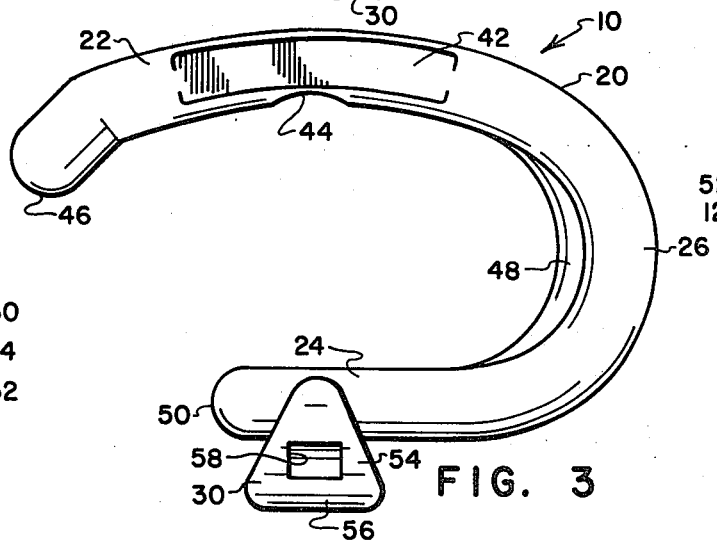
FIG. 3 is a rear side elevational view of the carrier of FIG. 2.

Referring to FIGS. 2, 3 and 8, the upper leg portion 22 has flats 40, 42 formed on its opposite sides to provide planar surfaces onto which a suitable name or other imprint may be inscribed. A notch 44 is formed in the underside of the upper leg portion 22 to facilitate hanging the carrier 10 on a coat rod, either by itself or while supporting a loaded garment bag as depicted in FIG. 1. A rounded formation 46 is provided at the end of the upper leg portion 22.

Referring to FIGS. 2–5, the central leg portion 26 is of generally round cross-section except for the provision of an inwardly extending reinforcing rib 48. The rib 48 strengthens the carrier and prevents the upper and lower leg portions 22, 24 from breaking apart.

Referring to FIGS. 2–8, the lower leg portion 24 is of generally round cross-section and terminates in a rounded end formation 50. The receiving structure 30 has side portions 52, 54 which depend from opposite sides of the lower leg portion 24 for supporting a bottom portion 56. The receiving opening 32 lies between the side portions 52, 54 and atop the bottom portion 56.

As is readily apparent in FIGS. 4, 6, 7, and 8, the receiving opening 32 is not of round cross-section, but rather is of elongate cross-section. The cross-section of the receiving opening 32 has its length oriented to extend horizontally, in directions transverse to the common plane of the upper, lower and central portions 22, 24, 26. As is readily apparent in FIG. 8, the elongate, transversely-extending orientation of the cross-section of the receiving opening 32 permits a plurality of hangers 12 to be received therein in an orderly, side-by-side arrangement.

Figure 6:
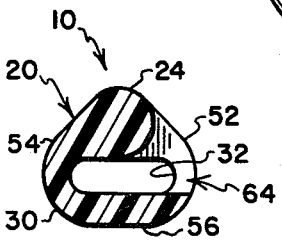
FIGS. 6 and 7 are sectional views as seen from planes indicated by lines 6—6 and 7—7 in FIG. 2.
Figure 7:
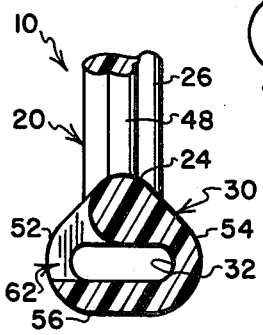

In order to facilitate molding of the carrier 10, the side portion 54 is made wider than the side portion 52, and is provided with a transversely extending passage 58 which intersects with the opening 32, as is best seen in FIGS. 3 and 8. The side portion 52 is narrower than the bottom portion 56 and thereby provides passages 62, 64, giving access to opposite ends of the receiving opening 32, as is best seen in FIGS. 2, 6 and 7. By this arrangement, the receiving opening 32 can be formed during molding by using three mold inserts (not shown) which move transversely with respect to the plane of the carrier 10. One of these mold inserts extends from one side of the plane of the carrier 10 to form the passage 58. The other two mold inserts extend from the opposite side of such plane to form the passages 62, 64.

Figure 9:
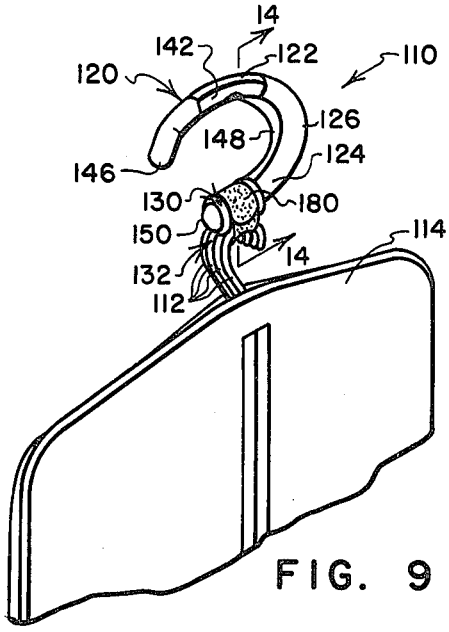
FIG. 9 is a perspective view showing an alternate embodiment of coat hanger carrier with the carrier's strap in receiving relationship with hanger hook portions projecting upwardly from a garment bag.

Referring to FIGS. 9–14, a coat hanger carrier of the type embodying an alternate, less preferred practice of the present invention is indicated generally by the numeral 110. In FIG. 9, the carrier 110 is shown in receiving relationship with a plurality of hanger-hook portions 112 which project upwardly from an opening in the top of a garment bag 114. As will be understood, the garment bag 114 protectively shrouds a plurality of garments (not shown) carried on the bottom portions (not shown) of the hangers whose hook portions 112 project upwardly from the garment bag 114.

Referring to FIGS. 10–14, the carrier 110 includes a substantially C-shaped member 120 having upper, lower and central portions 122, 124, 126 which overlie each other and which extend in substantially a common plane. The upper leg portion 122 is of sufficient size relative to the size of one's hand to effectively distribute the load of a plurality of heavily ladened garment-carrying hangers across the width of one's hand. The lower leg portion 124 is provided with a hanger-hook receiving structure 130 defining an opening 132 which extends parallel to at least a part of the bottom leg portion 124 to releasably receive and retain hanger hook portions 112 of a plurality of coat hangers with the hangers being oriented to extend substantially within the common plane of the C-shaped member.

Figure 10:
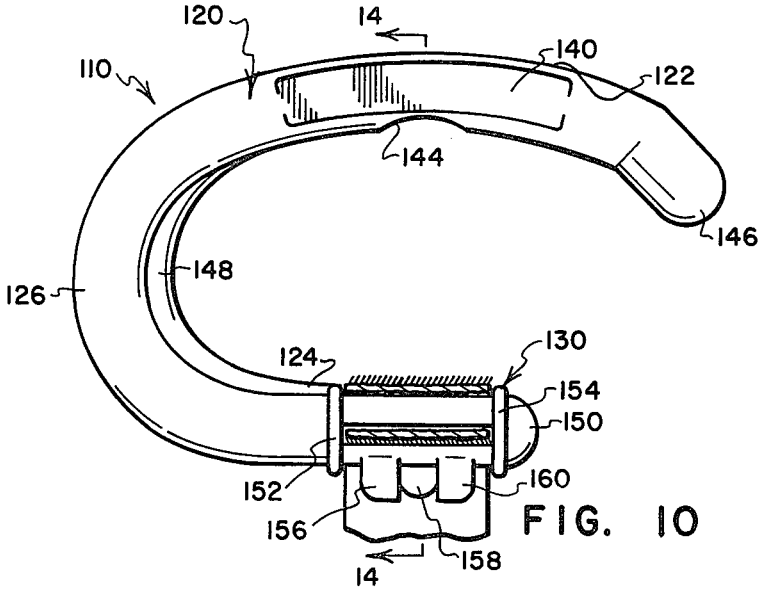
FIG. 10 is a front side elevational view, on an enlarged scale, of the carrier of FIG. 9, with the carrier's strap extended.
Figure 14:
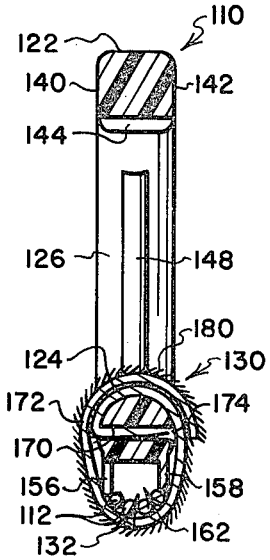
FIG. 14 is a sectional view as seen from a plane indicated by a line 14—14 in FIG. 9.
Figure 11:
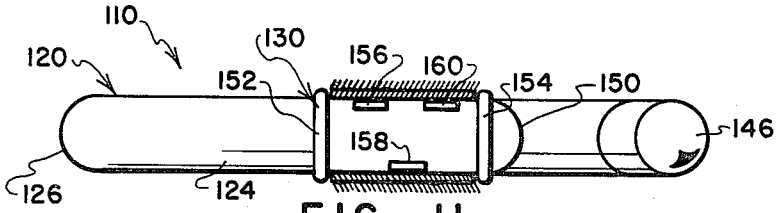
FIG. 11 is a bottom plan view of the carrier of FIG. 10.
Figure 12:
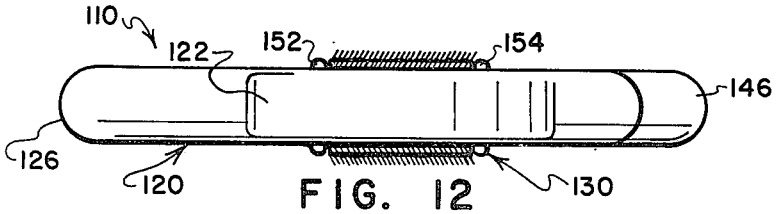
FIG. 12 is a top plan view of the carrier of FIG. 10.

Referring to FIGS. 10 and 14, the upper leg portion 122 has flats 140, 142 formed on its opposite sides to provide planar surfaces onto which a suitable name or other imprint may be inscribed. A notch 144 is formed in the underside of the upper leg portion 122 to facilitate hanging the carrier 110 on a coat rod, either by itself or while supporting a loaded garment bag as depicted in FIG. 9. A rounded formation 146 is provided at the end of the upper leg portion 122.

The central leg portion 126 is of generally round cross-section except for the provision of an inwardly extending reinforcing rib 148. The rib 148 strengthens the carrier 110 and prevents the upper and lower leg portions 122, 124 from breaking apart.

Figure 13:
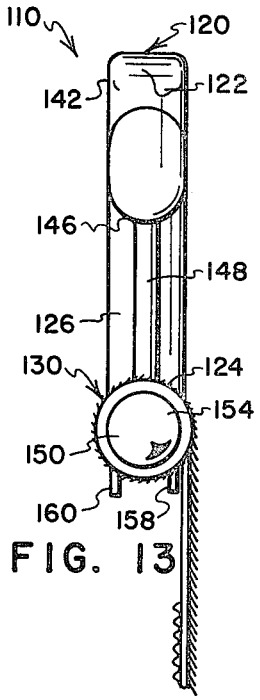
FIG. 13 is an end elevational view of the carrier of FIG. 10.

Referring to FIGS. 10, 13 and 14, the lower leg portion 124 is of generally round cross-section and terminates in a rounded end formation 150. The receiving structure 130 has a pair of spaced, enlarged, perimetrically extending flanges 152, 154, between which are located three depending projections 156, 158, 160 which cooperate to define a downwardly facing channel indicated in FIG. 14 by the numeral 162.

Referring to FIG. 14, a transversely extending passage 170 is formed through the receiving structure 130. A flexible strap of elongate material 172 has an enlarged end 174 located near one end of the passage 170 and extends through the passage 170. The end 174 is of such size that it cannot pass through the passage 170. The strap 172 is reeved around the top of the structure 130 and normally depends loosely, as is shown in FIGS. 10 and 13. When hanger hook portions 112 are to be received and retained by the carrier 110, the strap 172 is reeved around the hook portions 112, as shown in FIG. 14, and its end 180 is brought into overlying relationship with the remainder of the strap 172, as is seen in FIGS. 9 and 14. The strap 172 is provided with a suitable releasable connection to retain the end 180 in its overlying relationship. In preferred practice, a releasable connection is provided by forming the strap from a material which will adhere to itself on contact. A preferred material for forming the strap 172 is sold under the trademark Velcro.

As will be apparent from the foregoing description, the present invention provides a novel and improved carrier for transporting a plurality of heavily loaded garment hangers without unduly stressing one's hand.

Although the invention has been described in its preferred form with a certain degreee of particularity, it will be understood that the present disclosure of the preferred embodiment has been made only by way of example and that numerous changes may be resorted to without departure from the true spirit and scope of the invention as hereinafter claimed. It is intended that the patent shall cover, by suitable expression in the appended claims, whatever features of patentable novelty exist in the invention disclosed.

What is claimed is:

1. A carrier for releasably receiving, retaining and carrying hanger hook portions of a plurality of coat hangers comprising:

(a) a substantially C-shaped member having upper and lower leg portions which overlie each other and which extend substantially in a common plane;

(b) the upper leg portion being of sufficient size relative to the size of one's hand to effectively distribute the load of a plurality of garmet-carrying hangers across the width of one's hand;

(c) the lower leg portion having hanger-hook receiving means for defining an opening which extends within said common plane for releasably receiving and retaining hanger-hook portions of a plurality of coat hangers with such hangers oriented to extend substantially within said common plane; and, (d) the hanger-hook receiving means defining an elongate opening which, when viewed in cross-section, has a width extending in directions transverse to the common plane which is greater than the height of the opening as measured within the common plane, and having side portions which define opposite ends of the width of the opening, one of the side portions being of lesser length as measured along the length of the opening than the other.

2. The carrier of claim 1 wherein the receiving means is formed as an integral, one-piece part with the C-shaped member.

3. The carrier of claim 1 wherein:

(a) the side portions depend from opposite sides of the lower leg portion, and a bottom portion extends between the side portions; and, (b) the receiving opening is formed at a location between the side portions and above the bottom portion.

4. The carrier of claim 3 wherein at least one passage means extends through at least one of the side portions and communicates with the receiving opening for facilitating the formation of the receiving opening during molding of the carrier.

5. The carrier of claim 1 wherein the upper leg portion has at least one flat surface portion formed thereon for receiving a name inscription.

6. The carrier of claim 1 wherein notch means is provided in the lower surface of the upper leg portion for facilitating hanging the carrier on a conventional closet rod with the rod received in the notch means.

7. A carrier for releasably receiving, retaining and carrying hanger hook portions of a plurality of coat hangers comprising:

(a) a substantially C-shaped member having upper and lower leg portions which overlie each other and which extend substantially in a common plane;

(b) the upper leg portion being of sufficient size relative to the size of one's hand to effectively distribute the load of a plurality of garmet-carrying hangers across the width of one's hand;

(c) the lower leg portion having hanger-hook receiving means for defining an opening which extends within said common plane for releasably receiving and retaining hanger-hook portions of a plurality of coat hangers with such hangers oriented to extend substantially within said common plane; and, (d) the receiving means including:

(i) a pair of spaced, perimetrically extending flanges formed on the lower leg portion;

(ii) a slot formed through the lower leg portion at a location between the flanges; and, (iii) strap means extending through the slot and having a loop which is reevable around the leg portion to define the receiving opening.

8. The carrier of claim 7 wherein the lower leg portion has a plurality of depending projections extending on opposite sides of the receiving opening.

9. The carrier of claim 7 wherein the strap has one end region secured to the lower leg portion and has the other end region configured to be releasably attachable to the lower leg portion with a central part of the strap forming a loop defining said opening.

10. The carrier of claim 9 wherein the strap and the lower leg portion are provided with releasably connectable formations for releasably retaining the other end portion in engagement with the lower leg portion.

11. The carrier of claim 10 wherein the releasable connection formations are formed from synthetic materials which releasably adhere when pressed together.

* * * * *